United States Patent [19]

Asano

[11] 4,272,886

[45] Jun. 16, 1981

[54] SHAVER UNIT

[75] Inventor: Tamoru Asano, Seki, Japan

[73] Assignee: Kai Cutlery Center Co., Ltd., Seki, Japan

[21] Appl. No.: 24,403

[22] Filed: Mar. 27, 1979

[30] Foreign Application Priority Data

Mar. 28, 1978 [JP] Japan ..... 53-38894

[51] Int. Cl.[3] ..... B26B 21/06; B26B 21/52

[52] U.S. Cl. ..... 30/47; 30/86; 220/347

[58] Field of Search ..... 30/40.2, 47, 86; 206/352, 354; 220/346, 347

[56] References Cited

U.S. PATENT DOCUMENTS

| | | | |
|---|---|---|---|
| 2,472,582 | 6/1949 | Green | 220/346 |
| 3,967,375 | 7/1976 | Hoffschmidt | 30/86 X |
| 4,120,400 | 10/1978 | Kotyuk | 220/346 X |
| 4,174,034 | 11/1979 | Hoo | 220/347 X |

FOREIGN PATENT DOCUMENTS

| | | | |
|---|---|---|---|
| 2203235 | 8/1973 | Fed. Rep. of Germany | 30/86 |
| 1502258 | 3/1978 | United Kingdom | 220/346 |

*Primary Examiner*—Gary L. Smith

*Attorney, Agent, or Firm*—Norbert P. Holler

[57] ABSTRACT

A shaver unit comprises at least one blade unit, a case member and a cover member. The case member has a blade accommodating space defined therein for accommodating the blade unit while the shaver unit is not in use for shaving and a blade fitting recess for fittingly and detachably receiving the blade unit while the shaver unit is used for shaving. The cover member is detachably attached to the case member to cover the blade unit accommodated in the accommodating space. The case member further has a portion serving as a handle gripped by the user's hand during shaving.

3 Claims, 4 Drawing Figures

SHAVER UNIT

The present invention relates to a shaver unit and, more particularly, to a shaver unit which is designed and constructed for a higher safety and handiness.

Various shavers have been proposed and actually used up to now. Typical conventional shaver has a shaving blade unit which is constructed as a body separate from the shaver body including a handle or stem and a platform on which the shaving blade is to be mounted and fixed. In use, the shaving blade unit is attached and fixed to the shaver body in such manner as to exclude the direct touch of the user's finger with the cutting edge of the shaving blade.

Under this circumstance, the present invention aims at providing a shaver unit of the kind described, which is further improved to provide a higher safety and handiness.

To this end, according to the invention, there is provided a shaver unit comprising: at least one blade unit having a shaving blade; a case member having a blade accommodating space for accommodating therein said blade unit when said shaver is not used and a blade fitting recess for fittingly and detachably receiving the blade unit when the latter is used for shaving, the case member further having a portion adapted to be gripped by the user's hand so as to play also the role of a handle or stem gripped by the user's hand during shaving; and a cover member adapted to be fittingly and detachably attached to the case member in such a manner that the blade unit accommodated in the blade accommodating space of the case member is covered by the cover member.

Preferably, the cover member has at least one blade storing space for storing the blade unit, such that the blade unit stored in the blade storing space is accommodated in the blade accommodating space of the case member, as the cover member is fittingly attached to the case member.

Figure 1:
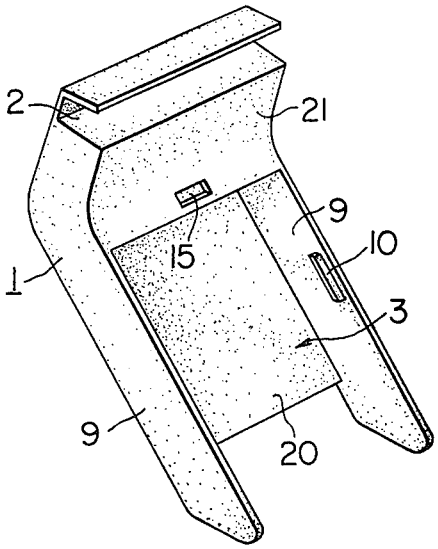
Figure 2:
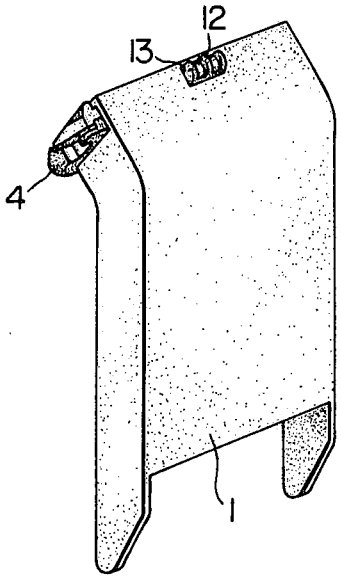
Figure 3:
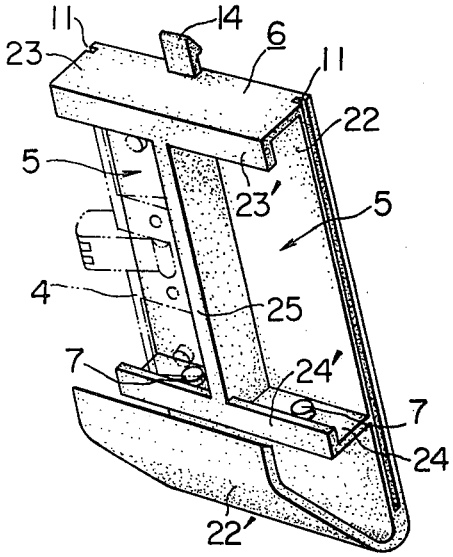
Figure 4:
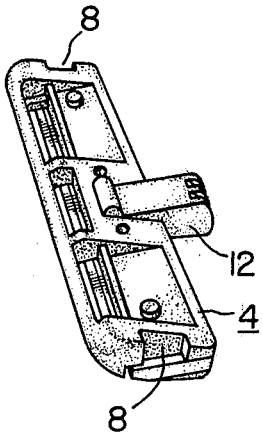

The above and other objects as well as advantageous features of the invention will become clear from the following description of the preferred embodiment of the invention taken in conjunction with the accompanying drawings in which:

FIG. 1 is a perspective view of a case member of a safety shaver in accordance with the invention, FIG. 2 is a perspective view of the cace member as shown in FIG. 1, as viewed from the back side, FIG. 3 is a perspective view of a cover member adapted to be fittingly attached to the case member as shown in FIG. 1, and FIG. 4 is a perspective view of a blade assembly adapted for use in combination with the case member and the cover member.

Referring first to FIGS. 1 and 2, a shaver unit of the invention has a case member generally designated by a reference numeral 1. The case member has a channel-like lower portion constituted by both side walls 9, 9 and a back panel 20, and an upper or head portion connected to the lower portion at a certain angle to the longitudinal axes of the side walls 9, 9. The upper portion is provided with a blade fitting recess 2 extending transversely of the case member 1 and open to the front side as well as to the lateral sides. The blade fitting recess 2 is adapted to fittingly receive a later-mentioned blade unit during shaving.

The distance between the side walls 9, 9, i.e. the breadth of the back panel 20, is so selected that the lower channel portion of the case member 1 constituted by the side walls 9, 9 and the back panel 20 can be easily and conveniently gripped by the user's hand. Thus, the lower channel portion of the case member plays the role of a handle or stem of the shaver unit. At the same time, the side walls 9, 9 and the back panel 20 in combination define a blade accommodating space 3 for accommodating the blade units, in a manner described later, while the shaver is not in use. As will be clearly seen from FIG. 1, a guide strip or protrusion 10, adapted for guiding a later-mentioned cover member, is formed on the inner surface of each side wall 9. The case member further has a recess 15 formed in its front surface 21 of the upper portion thereof, and an opening 13 formed in the bottom wall of the channel-like blade fitting recess 2, at the breadthwise mid point thereof.

Referring next to FIG. 3, the shaver unit of the invention has the cover member generally designated by a numeral 6. The cover member 6 as a whole has such a shape as to fit to the lower portion of the case member 1. More specifically, the cover member 6 includes a panel portion 22 which has a lower end bent upwardly rearwardly at an angle to form a bottom panel 22'. The panel 22' is adapted to close the bottom of the blade accommodating space 3 of the case member 1 when the cover member is fitted to the case member 1 as will be described later. The case member 6 further has an upper or head wall 23 formed integral with the panel portion 22 and extending over the breadth of the latter. The upper wall 23 extends rearwardly, i.e. in the same direction as the bottom panel 22', from the top end of the panel portion 22. The case member 6 further has a lower wall 24 which is unitary with the panel portion 22 and extending therefrom in the same direction as the upper wall 23. The upper and the lower walls 23, 24 are provided at their ends remote from the panel portion 22 with tabs 23', 24' in the form of penthouses. These tabs 23' and 24' are extending toward each other, and are connected to each other by means of a partition wall 25 which is also unitary with the panel portion 22. The panel portion 22 is provided at its both lateral or breadthwise ends with slide grooves 11 for the sliding engagement with the corresponding protrusions 10, 10 formed on the inner surfaces of the side walls 9, 9 of the case member 1, when the cover member 6 is attached to the case member 1. The panel portion 22, the upper and lower walls 23, 24 and the tabs 23', 24' in combination define a blade storing space 5 at each lateral side of the partition wall 25. Each of the blade storing spaces 5, 5 is adapted to receive and accommodate a blade unit 4 which is shown in FIG. 4, as illustrated by phantom line in FIG. 3. The upper and lower walls 23, 24 are formed with projections 7, 7 formed on their inner surfaces, i.e. on the surfaces confronting the blade storing spaces 5, 5. These projections are adapted for snapping engagement with recesses 8, 8 formed at lateral ends of the blade unit 4. On the outer surface of the upper wall 23, is formed an outwardly extending claw 14 adapted to make a snap fit in the recess 15 of the case member 1, when the cover member 6 is fitted to the latter.

The blade unit 4 has a shaving blade having a cutting edge which is not shown. The shaving blade may be of the type called double-edge blade having two superposed cutting edges. The blade unit 4 has a projection 12 extending rearwardly or rightwardly as viewed in FIG. 4 from a rear edge thereof, at the longitudinal mid point. The projection 12 is adapted to be received by and exposed through the opening 13 of the case member 1, when the blade unit 4 is fittingly received by the blade fitting recess 2 of the case member 1 in the manner which will be described later.

While the shaver is not in use, the blade units 4 are received and stored in the respective blade storing spaces 5, 5 at both sides of the partition wall 25 of the cover member 6. This is achieved simply by pressing each blade unit 4 into each blade storing space 5, with its projection 12 directed to the outside, until its recesses 8, 8 come to make snap fits with corresponding projections 7, 7 of the cover member 6, to the position as illustrated by the phantom line in FIG. 3.

Then, the cover member 6 in which two blade units 4 are stored is attached to the case member 1, until the claw 14 formed on the upper wall 23 come to snap-fit into the recess 15 of the case member 1. This is achieved smoothly thanks to the sliding engagement of the slide grooves 11 of the cover member 6 and the protrusions 10 of the case member 1. Partly because of the snap fit of the claw 14 of the cover member 6 with the recess 15 of the case member 1, and partly because of the engagement between the slide grooves 11 and protrusions 10, the cover member 6 is stably and fixedly supported in the case member. In this state, the blade units 4 stored in the blade storing spaces 5, 5 of the cover member 6 are completely accommodated in the blade accommodating space 3 of the case member 1. At the same time, the shaver in this state has a simple outer configuration formed by the upper and lower portions of the case member 1 and the cover member 6, without any particular convexity and concavity, and is made highly compact. Thus, the shaver unit of the invention in this state is quite handy and safe to carry.

When the shaver unit is used for shaving, the cover member 6 is detached from the case member 1, so that the blade units stored in the storing space of the cover member 6 are exposed. Then, the case member 1 and the cover member 6 are brought together such that the outer edge of one of the blade units in the cover member 6 is aligned with the blade fitting recess 2 of the case member 1. Then, the case member 1 and the cover member 6 are pressed toward each other so that the blade unit 4 may be inserted into the blade fitting recess 2, and the projection 12 of the blade unit 4 come to be projected through the opening 13 of the case member 1 as shown in FIG. 2. Subsequently, as the case member 1 is pulled away from the cover member 6, the blade unit 4 is transferred from the cover member 6 to the case member 1. The case member 1 having the blade unit 4 fittingly received in the blade fitting recess 2 can be directly used as a shaver, because, as described hereinbefore, the lower portion of the case member 1 conveniently plays the role of a handle. A better gripping at the lower portion of the case 1 will be obtained by attaching again the cover member to the case member, so as to ensure a better feel of use.

After shaving, the blade unit 4 may be detached from the case member 1, by gripping with fingers the lateral ends of the blade unit 4 and pulling the latter out of the recess 2, or pressing the projection 12 of the blade unit 4 into the opening 13. It will be understood that, in the shaver unit of the invention, the attaching and detaching of the shaving blade to and from the handle or stem can be made in quite a safe manner. Particularly, the attaching of the blade to the handle or stem can be made without necessitating direct touch of hand with the blade unit.

Having described the invention through its preferred form, it is to be noted that the described embodiment is not exclusive, and various changes and modifications may be imparted thereto.

For instance, the detachable fitting of the blade unit 4 into the blade storing space 5 can be made by other means than the cooperation of the projections 7 and recesses 8. At the same time, for smoothing the attaching of the cover member 6 to the case member 1, other suitable means than the protrusions 10 and the slide groove 11 may be adopted. In addition, the combination of the projection 12 and the opening 13, and the combination of the claw 14 and the recess 15 can be dispensed with as desired.

Further, the partition wall 25 which is provided on the cover member 6 in the illustrated embodiment may be provided in the case member 1.

What is claimed is:

1. A shaver unit comprising in combination:

at least one shaving blade unit;

a case member including a top portion and a bottom portion, said top portion defining a recess for detachably receiving said blade unit for use during shaving, said top portion curvedly extending from said bottom portion for offsetting said blade unit in said recess from said bottom portion and properly orienting said blade unit for shaving, said bottom portion having sidewalls and a first planar rectangular panel therebetween, a portion of said case member being operable as a handle for guiding said blade during shaving; and a cover member releasably interlocking with said case member and including a blade accommodating space for each blade unit for storing each blade unit in a fixed position when not in use during shaving and for dispensing said blade unit into said recess, said cover member including a second planar rectangular panel with a top and bottom wall, said second panel having an inner and an outer surface, said inner surface having walls associated therewith for partly defining said blade accommodating space, said second panel and said bottom portion interlocking so as to form a substantially box-like structure enclosing said blade accommodating space therewithin.

2. A shaver unit as claimed in claim 1, wherein said cover member has walls partly defining said blade accommodating space, some of said walls having projections, said blade unit including recesses for engaging said projections so as to maintain said blade unit in a fixed position.

3. A shaver unit as claimed in claim 1, wherein said case member has grooves and said cover member has guide protrusions for slidingly engaging said grooves, thereby interlocking said case member and said cover member.

* * * * *